US005484983A

United States Patent [19]

Roell

[11] Patent Number: 5,484,983

[45] Date of Patent: Jan. 16, 1996

[54] ELECTRIC HEATING ELEMENT IN KNITTED FABRIC

[75] Inventor: Friedrich Roell, Biberach, Germany

[73] Assignee: Tecnit-Techische Textilien Und Systeme GbmH, Germany

[21] Appl. No.: 210,912

[22] Filed: Mar. 21, 1994

Related U.S. Application Data

[63] Continuation-in-part of Ser. No. 943,730, Sep. 11, 1992, abandoned.

[30] Foreign Application Priority Data

Sep. 11, 1991 [CH] Switzerland ..... 02676/91

[51] Int. Cl.[6] ..... H05B 3/34; H05B 3/54

[52] U.S. Cl. ..... 219/545; 219/528; 219/529

[58] Field of Search ..... 219/545, 529, 219/528, 548, 549

[56] References Cited

U.S. PATENT DOCUMENTS

| | | | |
|---|---|---|---|
| 2,670,620 | 3/1954 | Goldstaub | 219/545 |
| 2,967,415 | 1/1961 | Ford | 219/545 |
| 3,472,289 | 10/1969 | Webber | 219/529 |
| 3,513,297 | 5/1970 | Jordan | 219/545 |
| 3,808,403 | 4/1974 | Kanaya et al. | 219/528 |
| 4,375,009 | 2/1983 | Fearnside | 219/545 |
| 4,538,054 | 8/1985 | de la Bretoniere | 219/545 |
| 4,700,054 | 10/1987 | Triplett et al. | 219/545 |
| 4,983,814 | 1/1991 | Ohgushi | 219/545 |

FOREIGN PATENT DOCUMENTS

| | | | |
|---|---|---|---|
| 166480 | 6/1989 | Japan | 219/545 |
| 669497 | 6/1979 | U.S.S.R. | 219/545 |
| 729854 | 5/1980 | U.S.S.R. | 219/545 |
| 839074 | 6/1981 | U.S.S.R. | 219/545 |

*Primary Examiner*—Teresa J. Walberg
*Assistant Examiner*—Sam Paik
*Attorney, Agent, or Firm*—Ostrolenk, Faber, Gerb & Soffen

[57] ABSTRACT

An electric heating element is formed of a knit fabric and includes current supply wires and resistance wires which are incorporated in the heating element. The different types of wires extend mutually perpendicularly in the heating element. The conductive wires may be disposed in local or edge regions spaced apart with the knit fabric located therebetween. The knit fabric located between the conductive wires may be formed of non-conductive fibers or resistance wires.

27 Claims, 4 Drawing Sheets

ELECTRIC HEATING ELEMENT IN KNITTED FABRIC

CROSS REFERENCE TO RELATED APPLICATION

This is a continuation-in-part of U.S. application Ser. No. 943,730, filed Sep. 11, 1992, now abandoned.

BACKGROUND OF THE INVENTION

The present invention refers to an electric heating element, more particularly a heating element to be used, e.g. for seat heaters in vehicles, in heating pads, heating blankets, heatable garments etc.

Such resilient and mostly also ductile heating elements are already known. They are generally formed of a flat envelope of synthetic textile material containing an electric resistance wire which is mostly inserted in a zigzag or meander shape but which may also have the form of a thin, flat ribbon.

Although they are resilient, these known heating elements have the drawback that they are poorly adapted to uneven or even bent supports. They are not extendable. If they are placed around the bend of the support, there is a risk that the resistance wire will be broken. In most cases, they are too thick to form a non-thickening layer, e.g. in car seats, and their manufacture is relatively expensive. Moreover, their electric heating power cannot be varied individually.

SUMMARY OF THE INVENTION

It is an object of the present invention to overcome the drawbacks of the known planar heating elements and to provide a new heating element for universal application which is simple in manufacture, and to provide a method for its manufacture.

This object is attained by an electric heating element which is formed of a textile knit fabric comprising at least two conductive, mutually separated current supply wires and resistance wires running from one of the current supply wires to the other. The current supply wires may be incorporated, according to the intarsia technique, in at least one course of respective superposed and mutually interlaced stitches. The resistance wires are incorporated in horizontal stitch courses at a mutual distance of at least one non-conductive stitch course. A solid, contact making stitch interlace is provided between the current supply and resistance wires.

Furthermore, a method for the manufacture of the novel heating element is provided, wherein the textile knit fabric is produced and one of resistance wires or current supply wires are additionally incorporated in the direction of the stitch courses, and the other of current supply wires or resistance wires, respectively, are incorporated in the direction of the stitch loops, and wherein the wires and/or the obtained textile knit fabric is coated or impregnated in a corrosion resistant or moisture resistant manner at least at the points of intersection of the current supply and resistance wires.

Thus the invention is based upon the idea of incorporating the heat producing wires of an electric resistance heating device into a resilient and extendable as well as drapable knit fabric.

The manufacture of knit fabrics by knitting is known and will not be described here again. The incorporation of the current supply wires and of the resistance wires may be carried out in particular on flat knitting machines in the most diverse ways.

The basic structure of the heating element of the invention is such that at least two resistance wires are arranged substantially in parallel to each other and are in electric contact with at least two current supply wires, while it is understood that the current supply wires must not be in contact among themselves, whereas a mutual contact of some resistance wires is not detrimental.

In the manufacture of the knit fabric, the wires may be inserted as weft yarns or warp yarns or both. Furthermore, incorporation as a replacement of the stitch yarn or as an addition to the stitch yarn may be considered. One of the wires may be incorporated by the intarsia technique if the connection perpendicularly to the knitting direction, i.e. of superposed stitches is concerned. The wire may also be a slightly twisted component of a stitch yarn.

Any construction of the knit fabric of the heating element may be chosen, e.g. right/right construction, jersey stitch, left/left construction, double stitch, etc. Also, transferred stitches may be used in order to obtain a reinforcement; this is particularly interesting for the current supply wires.

The known knitting techniques allow production of any shape of the heating surface. Even an almost semicircular arrangement of the current supply wires is possible. By graduations of the mutual distances of the current supply wires and/or by a varied density of the resistance wires or by the choice of different wire sizes, respectively, the most varied heating powers are possible over the surface of the fabric.

The necessary contact safety between the current supply wires and the resistance wires is positively ensured by the solid stitch interlacing of the planar textile structure, as has been shown in tests. In this context, the heating element of the invention is advantageously protected from corrosion and moisture, namely at least at the points of intersection, i.e. at the connections of the current supply wires and the resistance wires, where there is an additional risk of local element formation. For this purpose, the wires can be provided with a corrosion resistant, but electrically conductive, coating formed e.g. of a polymer which is made conductive by means of graphite, EC soot or germanium, or of an amide-imide polymer which is conductive itself. It is preferred, however, to impregnate the finished heating element at least in the area of the mentioned points of intersection in a corrosion resistant and moisture resistant manner, e.g. with a dispersion of silicon resins or polytetrafluorethylene which is subsequently dried. In some cases it is even better to use a silicon prepolymer, to dry and subsequently cross-link the applied solution or dispersion by thermal and/or catalytic means. Protective substances of this kind are known to one skilled in the art.

According to the desired purpose, the material for the wires may be chosen at will. Copper wires, which may be silvered as the case may be, may be considered for the current supply wires, and the known nickel-chrome alloy wires for the resistance wires.

The heating element of the invention may be manufactured in the form of a planar structure, but also three-dimensionally, e.g. as a preshaped car seat cover. It is further suitable for a fitting insertion in garments such as motorcycle garments, and it may be directly manufactured in the desired shape.

Besides the "net-like" knit fabrics described above, all other known weaves are applicable in connection with a heating conductor or with current supply wires, also in combination with a warp and/or weft reinforcement, and are capable of being produced without any problems. As also mentioned above, a planar (two-dimensional) or a three-dimensional structure may be concerned. Such three-dimensional structures and their manufacture are described in U.S. patent application Ser. No. 08/089,112 filed on Jul. 8, 1993 which claims the priority of Swiss Patent Application No. 2149/92 of Jul. 8, 1992 to the applicant. Specifically, the shape of the three-dimensional textiles is achieved by adding and/or removing loops and/or subsequent extensions.

The heating conductors may consist of a resistance wire or of other conductive materials and may be coated or sheathed as well. Neither do the heating conductors have to follow a "wave-shaped" course (see below, FIG. 1). A connection of the heating wire to the contact wire, i.e. the current supply wire after every passage is not required. By contrast, almost unlimited variations of the heating power are possible by incorporating resistance wires of different diameters, by a variable mutual distance of the wires and by an individual connection to the contact conductor.

The contact conductor, whose wire size, width and material may be dimensioned at will, does not necessarily have to be arranged perpendicularly or horizontally with respect to the knitting direction, but it may be adapted to the predetermined ideal shape and thus be arranged obliquely or in the shape of a curve, as mentioned above.

If three-dimensional heating elements are desired, the heating element need not first be manufactured two-dimensionally and then shaped, but it may be designed as a multidimensional structure with a variable heating power, as the case may be. Thus, the heating power remains precisely reproducible even punctually since a surface modification by subsequent shaping to achieve the spatial form is no longer required.

The heating element of the invention is manufactured in the desired form, as opposed to being yard ware. An expensive subsequent transformation by tailoring and sewing is thereby superfluous.

The heating power can be designed variably by the density of the resistance wire rows, by corresponding dimensioning of the wires, by the row width according to the contact conductor arrangement, and also by the weave variant, of course. It is thus no longer necessary to interrupt one or a plurality of resistance wires in order to realize the desired heating power. By contrast, the heating element of one embodiment of the invention is provided with two or more areas of heating wires which are connected by means of current supply wires on one side or not at all. It is thus possible to adapt the heating power to possible special requirements by a series or parallel connection of the current supply wires in a very simple manner.

Since the heating element of the invention can be manufactured on a weaving-knitting machine in its desired three-dimensional form and thus does not need to be thermally deformed after its manufacture, it is possible to use any type of fibers besides synthetic fibers as working yarns. Consequently, all the technical fibers including sheathed fibers may be processed, also in combination.

The heating element of the invention may be provided with a corrosion resistant and non-inflammable finish by plasma treatment and also by traditional treatments, possibly of the fibers already.

The heating element of the invention can be manufactured on textile machines, preferably on computer-controlled flat knitting machines. In addition to the planar and the three-dimensional structure, a so-called "two-and-a-half-dimensional" construction with a loop pile or a spacing structure, respectively, may be produced.

For a further explanation of the object of the invention, individual possibilities of inserting current supply and resistance wires are described below.

Knit fabric of the heating element is knitted with a yarn which generally consists of a suitable synthetic fiber in the form of a monofilament or a staple fiber yarn or else of a microfiber yarn, such as polyester, polyurethane, polyamide, or high temperature resistant fibers such as Nomex. Of course, the material of yarn must be chosen such as to withstand the desired temperature of the heating element.

The current supply which may be a thin copper wire or a strand, and may be incorporated by the intarsia technique.

It is understood that a reduction of the extendability in the corresponding direction occurs if warp or weft wires respectively are used. Highly extendable heating elements according to the invention are therefore preferably produced with intarsia wires and interlaced heating wires.

The current supply wires may also be incorporated with the set-up line. The current is drained by the final set-up line through the adjacent knitting of any type containing heating wires. Thus a heating element with "horizontal" current supply wires and "vertical" resistance wires is obtained.

As additional possible knitting techniques, tucking and stitch transfer may be mentioned, and as additional applications, the construction of tool heaters, container heaters, pipe heaters, etc.

Other features and advantages of the present invention will become apparent from the following description of the invention which refers to the accompanying drawings.

BRIEF DESCRIPTION OF THE DRAWINGS

The present invention will be described below with reference to several embodiments. With respect to said embodiments.

DETAILED DESCRIPTION OF THE INVENTION

Figure 1:
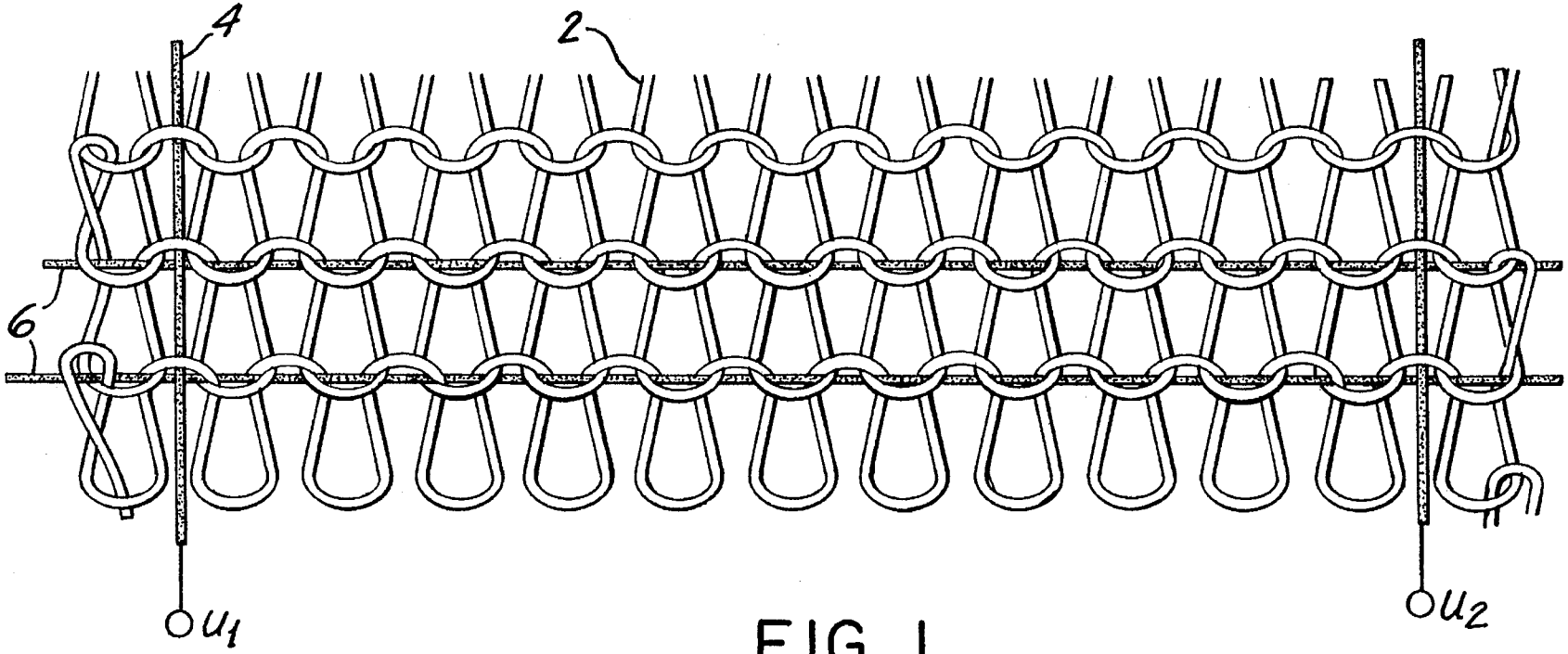
FIG. 1 shows a knitted fabric with warp threads incorporated therein as current feed wires and weft threads as filling threads and as resistance wires.

FIG. 1 shows a fabric in the form of a basic knitted mesh structure 2 of non-conductive threads, in which good, low resistance, current conductors 4 are incorporated as warp threads. The conductors are connected to each other by filling threads 6 in the form of resistance heating wires. The heating resistance wires 6 are thus superimposed, together with the current feed wires 4, as a woven structure on the basic knitted mesh structure so that this embodiment forms a woven mesh structure having the knitted mesh structure 2 as a support structure and the interwoven filling and warp threads as the heating element. By selecting quantity and placement of the resistance wires 6 incorporated as filing threads, the heating performance of the textile area in question can be adjusted.

Figure 2:
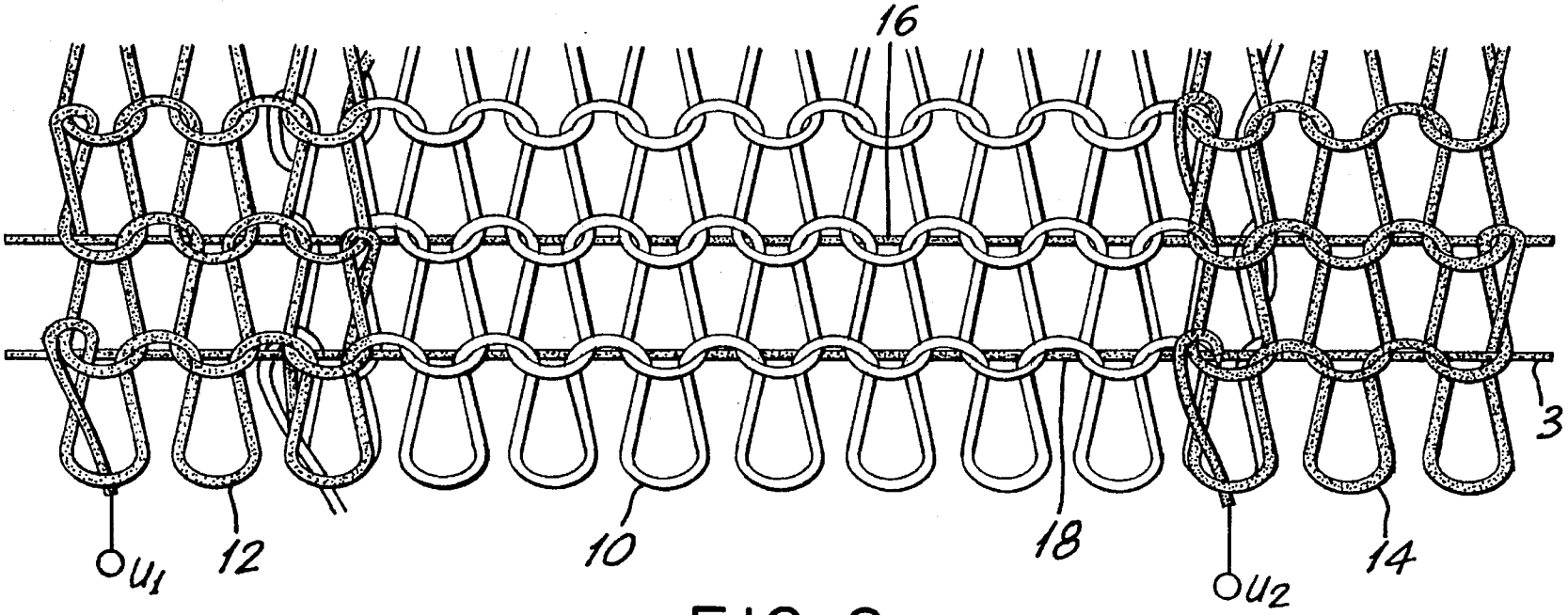
FIG. 2 shows another heating structure with current conducting mesh areas which are separated from each other by insulating mesh areas and filling threads incorporated as resistance wires.

FIG. 2 also shows a flexible knitted mesh fiber structure 10 which is knitted or is of some other hosiery or mesh type. It is connected at both of its edge regions to two separated current conducting mesh structures 12, 14. The connection of the central non-conductive structure to each outer conductive structure is by knitting each edge region over the adjacent edge region of the adjacent structure. Filling threads 16, 18 are introduced into and extend across the textile material formed by the three neighboring structures 10, 12, 14. Those filling threads are developed as resistance heating wires. In the conductive mesh structures 12, 14, the resistance heating wires 16, 18 are connected to the knitted current feeds in those structures. The current feed wires, which are also present as knitted mesh structures 12, 14, may comprise either an insulating thread which is wrapped by a current conductor or a current conducting thread. Also, in this embodiment, the number of, i.e., the distance between successive filling threads 16, 18 contributes to determining the heating performance.

Figure 3:
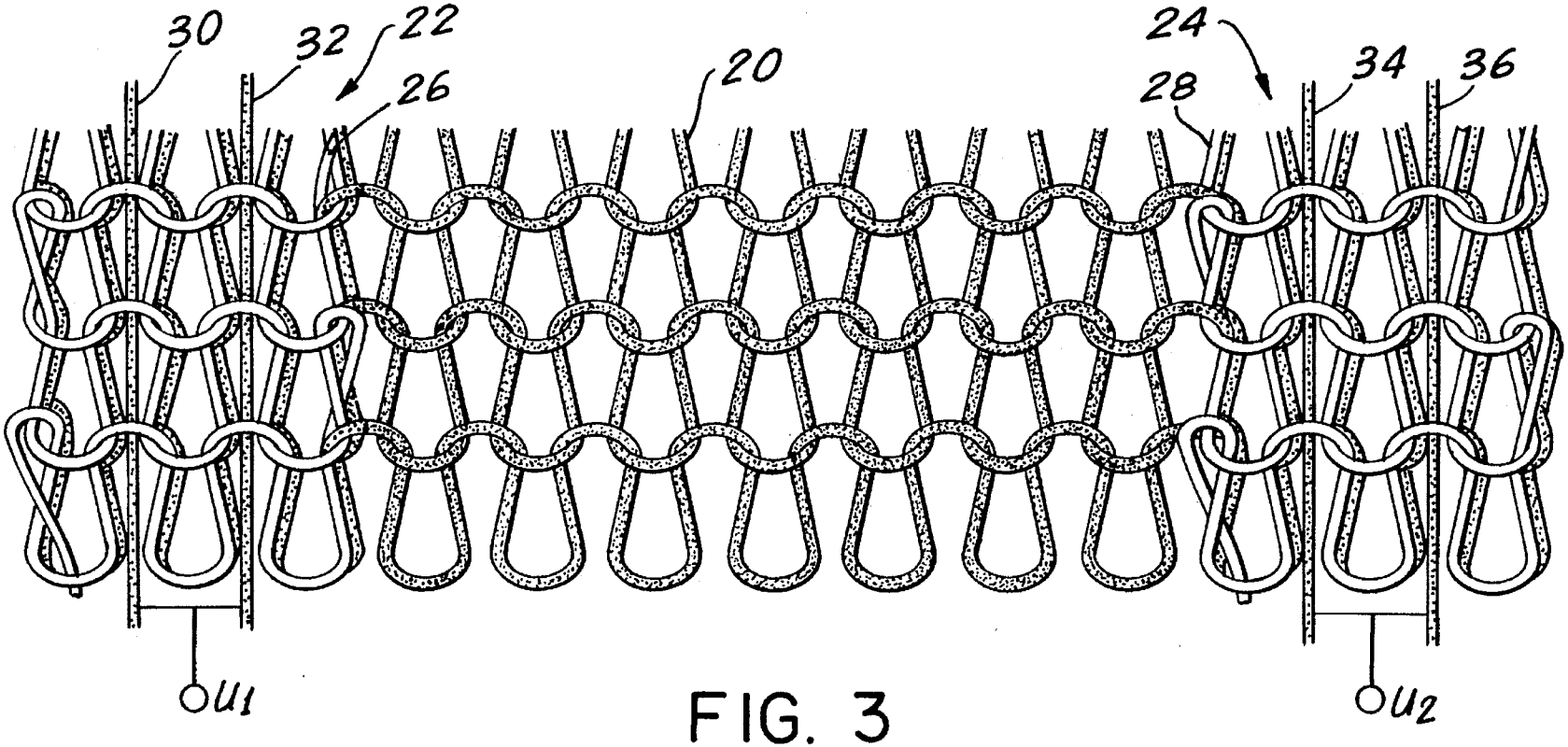
FIG. 3 shows an embodiment having current feed wires in the form of warp threads and resistance wires present as mesh structure.

FIG. 3 shows a flexible basic knitted mesh structure 20 which is entirely comprised of a resistance heating wire or of an insulating thread which is wrapped by a resistance heating wire. In the edge structures 22, 24 on the edge regions of the central mesh structure 20, a respective insulating thread 26, 28 is superimposed on the resistance heating wire 20 at the edge region. The insulating thread mechanically supports the mesh structure 20 of the resistance heating wire. The current feed wire pairs 30, 32 and 34, 36 are incorporated in the edge regions 22, 24, respectively. The current feed wire pairs 30, 32 and 34, 36, respectively, in each case, are acted on by the same voltage $U_1$ and $U_2$. In the region 20 of the mesh structure, there is thus applied a voltage $\Delta U = U_1 - U_2$ between the current feed wire pairs 30, 32 and 34, 36, respectively. That voltage is converted into heat corresponding to the ohmic resistance of the structure 20 present between the wire pairs. By using current feed wire pairs 30, 32 and 34, 36, and by having each pair (or even more wires than one pair) connected in electrical parallel, this assures the supply of current to the respective heating element even if one current feed wire 30, 32, 34, 36 breaks. Obviously, the structure of the resistance wire in this and the other embodiments provides similar assurance upon breakage of one resistance wire. The current feed wires are firmly maintained in the overall mesh structure in the form of the warp threads 30, 32, 34, 36 between the insulating thread 26 and the resistance heating thread of the structure 20. By direct application of the current feed wires 30, 32, 34, 36 to the resistance wires in several areas, smooth operation of the entire heating mesh structure is assured.

Figure 4:
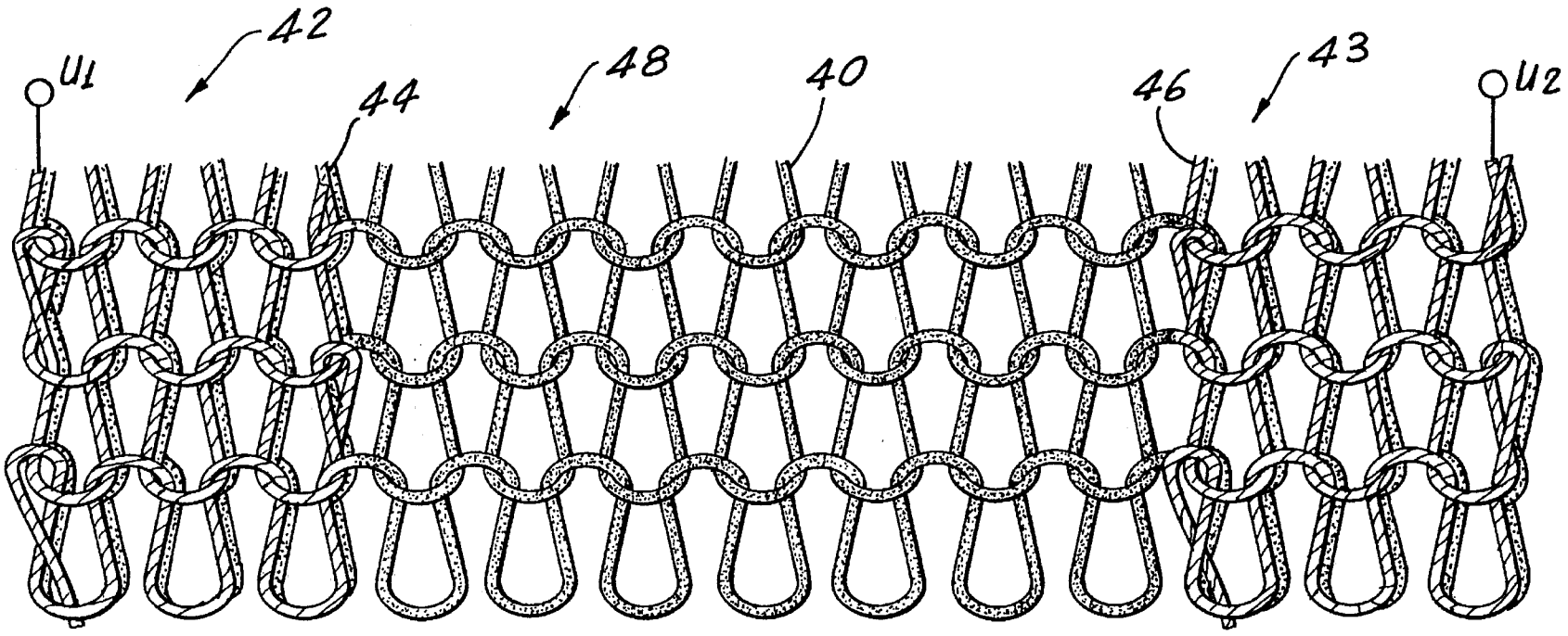
FIG. 4 shows an embodiment in which both the current feed wires and the resistance wires are present as mesh structure.

FIG. 4 also shows a mesh structure 40 which is entirely comprised of a resistance wire. Current conducting wires 44, 46, which have a very low resistance and serve as the current feeds, extend through two lateral sections 42, 43 which extend parallel to the central resistance wire mesh structure 40. The wire 40 extends into the lateral sections 42, 43. In the regions of the two lateral sections 42, 43, the resistance wire 40 is at a substantially identical potential due to the much lower resistance of the current feed wires 44, 46, while the resistance wire extends by itself over a central section 48. Thus, in the central section 48 between the two lateral sections 42, 43, the current flowing through the resistance wire 40 is determined by the potential difference $\Delta U = U_1 - U_2$, which is applied between the two regions 42, 43. Instead of the illustrated joint knitting of the resistance wire 40 and the current feed wires 44 or 46 in the lateral edge sections 42 and 43, the current feed wires 44, 46 and the resistance wire 40 can also be connected to each other merely at their adjoining edge regions, e.g., as shown in FIG. 2.

Insulating threads, which are wrapped by a resistance wire, can be used in all embodiments instead of a plain resistance wire. The function of the resistance wires is merely to produce heat, as a result of the voltage drop taking place along them. The current carrying or current conducting wires can also be comprised of insulated wires which are wrapped by a current conducting wire. For the current carrying wires, any conductive materials can be used provided the materials have a sufficiently low resistance as compared with the resistance heating wires.

According to the present invention, either the current carrying wires or the resistance heating wires or the support structure for those wires are formed of a knitted fabric so that the heating element is very elastic and retains its operability even when it is strongly deformed. The heating element furthermore retains its operability if a conductor breaks. In this case, only a very small amount of the heating element is lost for the further production of current since both the current feed and the generation of heat take place over several parallel current paths.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electric heating element comprising:

a central mesh structure having a pair of edge portions;

a first and second conductive interlace mesh structure formed by knitting conductive, separated current supply wires, said first conductive interlace mesh structure being attached to one of said pair of edge portions of the central mesh structure and said second conductive interlace mesh structure being attached to the other of said pair of edge portions of the central mesh structure;

a plurality of electric resistance wires extending between and connected to the current supply wires forming the first and second conductive interlace mesh structures, such that the current supply wires supply current to the resistance wires, the resistance wires extending through and along the central mesh structure for supplying heat to the central mesh structure; wherein each of the first and second conductive interlace mesh structures form a plurality of electrical connections with each of the resistance wires at each of the pair of edge portions of the central mesh structure such that the current supply to at least some of the resistance wires continues even upon at least one of breakage and inoperability of at least one of the conductive wires.

2. The electric heating element of claim 1, wherein the current supply wires are arranged generally to extend along the central mesh structure in one of the horizontal and vertical directions while the resistance wires are arranged to extend through the central mesh structure generally in the other of the horizontal and vertical directions.

3. The electric heating element of claim 1, wherein the electrically conductive wires are arranged spaced apart from each other on either side of the central mesh structure, the conductive wires forming each of the first and second conductive interlace mesh structures defining conductive regions extending generally perpendicular to a direction of extension of the resistance wires, the resistance wires extending through the first and second conductive interlace mesh structures.

4. The electric heating element of claim 3, wherein the central mesh structure located between the first and second conductive interlace mesh structures at least in part is comprised of a resistance wire and a knitted non-conductive fabric.

5. The electric heating element of claim 3, wherein the central mesh structure located between the first and second conductive interlace mesh structures is comprised of the plurality of resistance wires which are interconnected to form a resistive interlace mesh member which is located between the first and second conductive interlace members.

6. The electric heating element of claim 1, wherein the central mesh structure located between the first and second conductive interlace mesh structures at least in part is comprised of a resistance wire and a knitted non-conductive fabric.

7. The electric heating element of claim 3, wherein each of the first and second conductive interlace mesh structures has an edge region thereof connected to an adjacent edge portion of the central mesh structure.

8. The electric heating element of claim 7, wherein the connected edge regions of the first and second conductive interlace structures and the edge portions of the central mesh structure are partially knitted together.

9. The electric heating element of claim 3, wherein each of the first and second conductive interlace mesh structures is knitted onto the central mesh structure.

10. The electric heating element of claim 9, wherein the central mesh structure is comprised of the resistance wires, and the electrically conductive wires in the first and second conductive interlace mesh structures are knitted onto the resistance wires.

11. The heating element of claim 1, wherein at least one of the resistance wires and the current supply wires are provided with a corrosion and moisture resistant coating.

12. The heating element of claim 1, wherein the resistance wires are incorporated simultaneously as an addition to the central mesh structure.

13. The heating element of claim 12, wherein the resistance wire is twisted with the central mesh structure.

14. The heating element of claim 1, wherein the current supply wires are in the form of additionally knitted-in warp or weft yarns.

15. The heating element of claim 1, wherein the resistance wires are in the form of additionally knitted-in warp or weft yarns.

16. The heating element of claim 1, wherein the current supply wires and the resistance wires are incorporated in a three-dimensional weaving knit fabric.

17. A method of making an electric heating element, the method comprising the steps of:

knitting a knitted mesh structure having first and second edge portions;

forming first and second conductive interlace mesh members from a plurality of electrically conductive, separated, current supply wires;

attaching the first conductive interlace mesh member to the first edge portion of the knitted mesh structure;

attaching the second conductive interlace mesh member to the second edge portion of the knitted mesh structure; and attaching a plurality of resistance wires between the first and second conductive interlace mesh members so that the resistance wires extend from the first conductive interlace mesh member to the second interlace mesh member through the knitted mesh structure and so that each of the first and second conductive interlace mesh members form a plurality of electrical connections with each of the resistance wires so that current supply to at least some of the resistance wires continues even upon at least one of a breakage and inoperability of at least one of the conductive wires.

18. The method of claim 17, wherein at least said resistance wires are provided with a corrosion-resistant yet electrically conductive coating.

19. The method of claim 17, wherein the produced electric heating element is provided with a water-repellent, heat-resistant impregnation with one of a dispersion and a solution of one of a silicon resin and a fluorocarbon resin with subsequent drying.

20. The method of claim 19, wherein a cross-linkable silicon prepolymer is used and cross-linked one of during drying and after drying.

21. The method of claim 17, wherein the knitted mesh structure comprises the plurality of resistance wires which are interconnected to form a resistive interlace mesh member which is located between the first and second conductive interlace mesh members.

22. The method of claim 17, wherein the knitted mesh structure comprises a non-conductive textile fabric.

23. An electric heating element comprising:

a central mesh structure having first and second edge portions and being formed of only a resistive interlace mesh structure consisting of a plurality of interconnected electrical resistance wires;

a first pair of conductive current feed wires attached to the first edge portion of the central mesh structure so as to be spaced from each other and to provide a plurality of electrical connections between each of the resistance wires and each of the first pair of conductive current feed wires; and a second pair of conductive current feed wires attached to the second edge portion of central mesh structure so as to be spaced from each other and to provide a plurality of electrical connections between each of the resistance wires and each of the second pair of conductive current feed wires.

24. The electric heating element of claim 23, further comprising a first insulating thread superimposed on the resistance wires located at the first edge portion to mechanically support the first edge portion of the central mesh structure and a second insulating thread superimposed on the resistance wires located at the second edge portion to mechanically support the second edge portion of the central mesh structure.

25. The electric heating element of claim 23, wherein said central mesh structure extends in a substantially horizontal direction and said first and second pairs of conductive current feed wires extend in a direction substantially perpendicular to the substantially horizontal direction.

26. A method of making an electric heating element, the method comprising the steps of:

forming a central mesh structure having first and second edge portions and being formed of only a resistive interlace mesh structure consisting of a plurality of interconnected electrical resistance wires;

attaching a first pair of conductive current feed wires to the first edge portion of the central mesh structure so that the first pair of conductive current feed wires are spaced from each other and form a plurality of electrical connections between each of the resistance wires and each of the first pair of conductive current feed wires; and attaching a second pair of conductive current feed wires to the second edge portion of the central mesh structure so that the second pair of conductive current feed wires are spaced from each other and form a plurality of electrical connections between each of the resistance wires and each of the second pair of conductive current feed wires.

27. The method of claim 26, further comprising the steps of superimposing a first insulating thread on the resistance wires located at the first edge portion so that the first insulating thread supports the first edge portion of the central mesh member and superimposing a second insulating thread on the resistance wires located at the second edge portion so that second insulating thread supports the second edge portion of the central mesh member.

* * * * *

UNITED STATES PATENT AND TRADEMARK OFFICE

CERTIFICATE OF CORRECTION

PATENT NO. : 5,484,983

DATED : January 16, 1996

INVENTOR(S) : Friedrich Roell

It is certified that error appears in the above-indentified patent and that said Letters Patent is hereby corrected as shown below:

Title page,
At item [73], the Assignee's name is written as "Tecnit-Techische Textilien Und Systeme GbmH and should read as --Tecnit-Technische Textilien und Systeme GmbH--.

Signed and Sealed this

Twenty-second Day of October, 1996

*Attest:*

Bruce Lehman

BRUCE LEHMAN

*Attesting Officer*

*Commissioner of Patents and Trademarks*